US006776473B2

(12) United States Patent
Huang et al.

(10) Patent No.: US 6,776,473 B2
(45) Date of Patent: Aug. 17, 2004

(54) METHOD OF MIXING MULTI-LEVEL BLACK AND COLOR INKS IN A PRINTING SYSTEM

(75) Inventors: Xuan-Chao Huang, Lexington, KY (US); Brant Dennis Nystrom, Lexington, KY (US); Richard L. Reel, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/320,763

(22) Filed: Dec. 16, 2002

(65) Prior Publication Data

US 2004/0113978 A1 Jun. 17, 2004

(51) Int. Cl.[7] ..... B41J 2/21; B41J 2/205

(52) U.S. Cl. ..... 347/43; 347/15

(58) Field of Search ..... 347/43, 15; 358/3.01, 358/3.03, 3.13, 3.23; 382/162

(56) References Cited

U.S. PATENT DOCUMENTS

| | | | | |
|---|---|---|---|---|
| 4,412,225 A | | 10/1983 | Yoshida et al. | 346/1.1 |
| 4,751,535 A | | 6/1988 | Myers | 346/157 |
| 4,855,753 A | | 8/1989 | Ichikawa et al. | 346/1.1 |
| 4,941,039 A | | 7/1990 | E'Errico | 358/80 |
| 4,952,942 A | | 8/1990 | Kanome et al. | 346/1.1 |
| 4,974,067 A | | 11/1990 | Suzuki et al. | 358/75 |
| 5,231,504 A | | 7/1993 | Magee | 358/75 |
| 5,657,137 A | * | 8/1997 | Perumal, Jr. et al. | 358/502 |
| 5,710,824 A | | 1/1998 | Mongeon | 382/162 |
| 5,784,172 A | | 7/1998 | Coleman | 358/298 |
| 5,793,501 A | | 8/1998 | Murakami | 358/520 |
| 5,805,314 A | | 9/1998 | Abe et al. | 358/518 |
| 5,835,244 A | | 11/1998 | Bestmann | 358/523 |
| 5,872,898 A | | 2/1999 | Mahy | 395/109 |
| 5,900,862 A | | 5/1999 | Silverbrook et al. | 345/154 |
| 5,909,291 A | | 6/1999 | Myers et al. | 358/523 |
| 5,978,011 A | | 11/1999 | Jacob et al. | 347/251 |
| 6,052,195 A | | 4/2000 | Mestha et al. | 356/425 |

(List continued on next page.)

OTHER PUBLICATIONS

Color Printer Characterization Using a Computational Geometry Approach, by Jon Yngve Hardeberg and Francis Schmitt; Aug. 14, 1997; http://hardcolor.virtualave.net/CIC1997/cic1997.html.

(List continued on next page.)

*Primary Examiner*—Thinh Nguyen
(74) *Attorney, Agent, or Firm*—Taylor & Aust, P.C.

(57) ABSTRACT

A method for mixing ink for use in an imaging apparatus including an ink jet printer capable of printing a plurality of primary color inks includes the steps of identifying available printing levels for each of the primary color inks, determining a target color profile for each of the primary color inks, and determining a graininess factor for each printing level. A mixing order is set up for at least some of the available printing levels, based in part on corresponding graininess factors and at least one mixing rule. At least a portion of the plurality of available printing levels is mixed, based on the mixing order and the target color profile, generating a plurality of mixing tables. Each mixing table corresponds to one of each of the primary color inks.

27 Claims, 15 Drawing Sheets

U.S. PATENT DOCUMENTS

| | | | | |
|---|---|---|---|---|
| 6,061,501 | A | 5/2000 | Decker et al. | 395/109 |
| 6,070,964 | A | 6/2000 | Sumiya | 347/43 |
| 6,072,464 | A | 6/2000 | Ozeki | 345/154 |
| 6,088,122 | A | 7/2000 | Coleman | 358/1.9 |
| 6,115,138 | A | 9/2000 | Yanaka | 358/1.9 |
| 6,130,686 | A | 10/2000 | Danzuka et al. | 347/43 |
| 6,137,594 | A | 10/2000 | Decker et al. | 358/1.9 |
| 6,137,596 | A | 10/2000 | Decker et al. | 358/1.9 |
| 6,172,692 | B1 | 1/2001 | Huang et al. | 347/43 |
| 6,229,916 | B1 | 5/2001 | Ohkubo | 382/167 |
| 6,281,984 | B1 | 8/2001 | Decker et al. | 358/1.9 |
| 6,312,102 | B1 | 11/2001 | Moriyama et al. | 347/43 |
| 6,313,925 | B1 | 11/2001 | Decker et al. | 358/1.9 |
| 6,377,366 | B1 | 4/2002 | Usami | 358/520 |
| 6,381,036 | B1 | 4/2002 | Olson | 358/1.9 |
| 6,386,670 | B1 | 5/2002 | Huang et al. | 347/15 |
| 6,394,612 | B1 | 5/2002 | Yano | 357/457 |
| 6,421,140 | B1 | 7/2002 | Hui | 358/1.9 |
| 6,580,822 | B1 * | 6/2003 | Takei | 382/162 |
| 2002/0097294 | A1 | 7/2002 | Shibata et al. | 347/43 |

OTHER PUBLICATIONS

Black generation using lightness scaling, by Tomasz J. Cholewo; http://ci.uofl.edu/tom/papers/Cholewo00eig–titled.pdf.

Modeling the Color of Multi–Colored Halftones, by J. A. Stephen Viggiano http://www.rit.edu/~jasvppr/1990_TAGA.pdf.

* cited by examiner

CMYK FULL GAMUT

CMY FULL GAMUT

OPTIMIZED MIXED
CMYK FULL GAMUT

CMYK FULL GAMUT

METHOD OF MIXING MULTI-LEVEL BLACK AND COLOR INKS IN A PRINTING SYSTEM

BACKGROUND OF THE INVENTION

1. Field of the Invention

The present invention relates to an imaging apparatus, and, more particularly, to a method for mixing black and color inks in a multi-level printing system.

2. Description of the Related Art

In recent years color printers have been developed for home and office use. These printers have typically used four different inks in the colors of cyan, magenta, yellow, and black (hereinafter, CMYK). If the cyan, magenta, and yellow (hereinafter, CMY) inks are ideal, the black ink is not necessary for producing the desired color gamut. In practice, however, the black ink is required for higher quality printing since the CMY inks can not produce the desired darkness as provided by the black ink for most papers. In addition, producing the same darkness requires approximately three times the amount of ink for CMY printing than for CMYK printing. Most papers cannot sustain this much ink for dark images, which require more ink. Accordingly, the introduction of black ink in color printing is important.

Typically, in CMYK printing, each of the color inks are used in either a single high concentration, i.e., a saturated ink, or a single relatively large drop mass, which normally produce grainy images. To overcome this granularity problem in using saturated inks or large drop masses, diluted inks and/or small drop masses (small dots) have been employed. These diluted inks and/or small drop masses are used to reproduce the less intense colors of the CIELAB system, while the more intense colors require the usage of the saturated inks or large drop masses. In some printing systems, only diluted forms of the cyan and magenta inks are used. In other printing systems, a color ink may not only have both diluted and saturated inks, but may also have both small and large drop masses. In general, we call these printing systems multilevel printing systems. The number of printing levels of each primary color ink (cyan, magenta, yellow, or black) is identified by the ink concentration and drop masses available for use by the printing system. For example, a cyan ink that can be printed with diluted small dots, diluted large dots, saturated small dots, and saturated large dots will be identified as a four-printing-level primary ink used in a four-printing-level printing system.

What is needed in the art is a method of mixing black ink with color inks for use in a multi-level printing system.

SUMMARY OF THE INVENTION

The present invention provides a method of mixing black ink with color inks for use in a multi-level printing system.

The invention, in one form thereof, is directed to a method for mixing ink for use in an imaging apparatus including an ink jet printer capable of printing a plurality of primary color inks includes the steps of identifying a plurality of available printing levels for each of the plurality of primary color inks; determining a target color profile for each of the plurality of primary color inks; determining a graininess factor for each printing level of the plurality of available printing levels for each of the plurality of primary color inks; setting a mixing order for at least a portion of the plurality of available printing levels for each of the plurality of primary color inks based in part on corresponding graininess factors and at least one mixing rule; and mixing the at least a portion of the plurality of available printing levels based on the mixing order and the target color profile to generate a plurality of mixing tables, wherein one of each mixing table of the plurality of mixing tables corresponds to one of each of the plurality of primary color inks.

In another form thereof, the invention is directed to a method for mixing ink for use in an imaging apparatus, including the steps of providing a plurality of multilevel primary color inks, the plurality of multilevel primary color inks including a plurality of non-black multilevel primary color inks and a black multilevel primary color ink; determining for each multilevel primary color ink of the plurality of multilevel primary color inks a corresponding target color profile; generating for each multilevel primary color ink a corresponding mixing table based on the corresponding target color profile; mixing a black ink K with each non-black multilevel primary color ink of the plurality of non-black multilevel primary color inks using each the corresponding mixing table in mixing a plurality of CMY points in a CMY color space into a plurality of corresponding mixed CMYK points in a mixed CMYK color space wherein a process black amount in each CMY point of the plurality of CMY points is replaced, at least in part, with an amount of the black ink K for use in each corresponding mixed CMYK point of the plurality of corresponding mixed CMYK points; and optimizing a total amount of the black ink K used in the mixing step, wherein the process black amount is an amount of black color in each of the plurality of CMY points that exists without the use of black ink.

An advantage of the present invention is the ability to mix black ink into a CMY color space to produce a mixed CMYK color space using primary color inks that can be printed with more than one printing level, resulting in a printing method that uses less ink and results in less bleed through in the recording medium than the use of conventional color spaces.

Another advantage is the ability to produce a mixed CMYK color gamut for a multi-level printing system that is larger than conventional color gamuts, allowing better matching of RGB colors with printed output.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
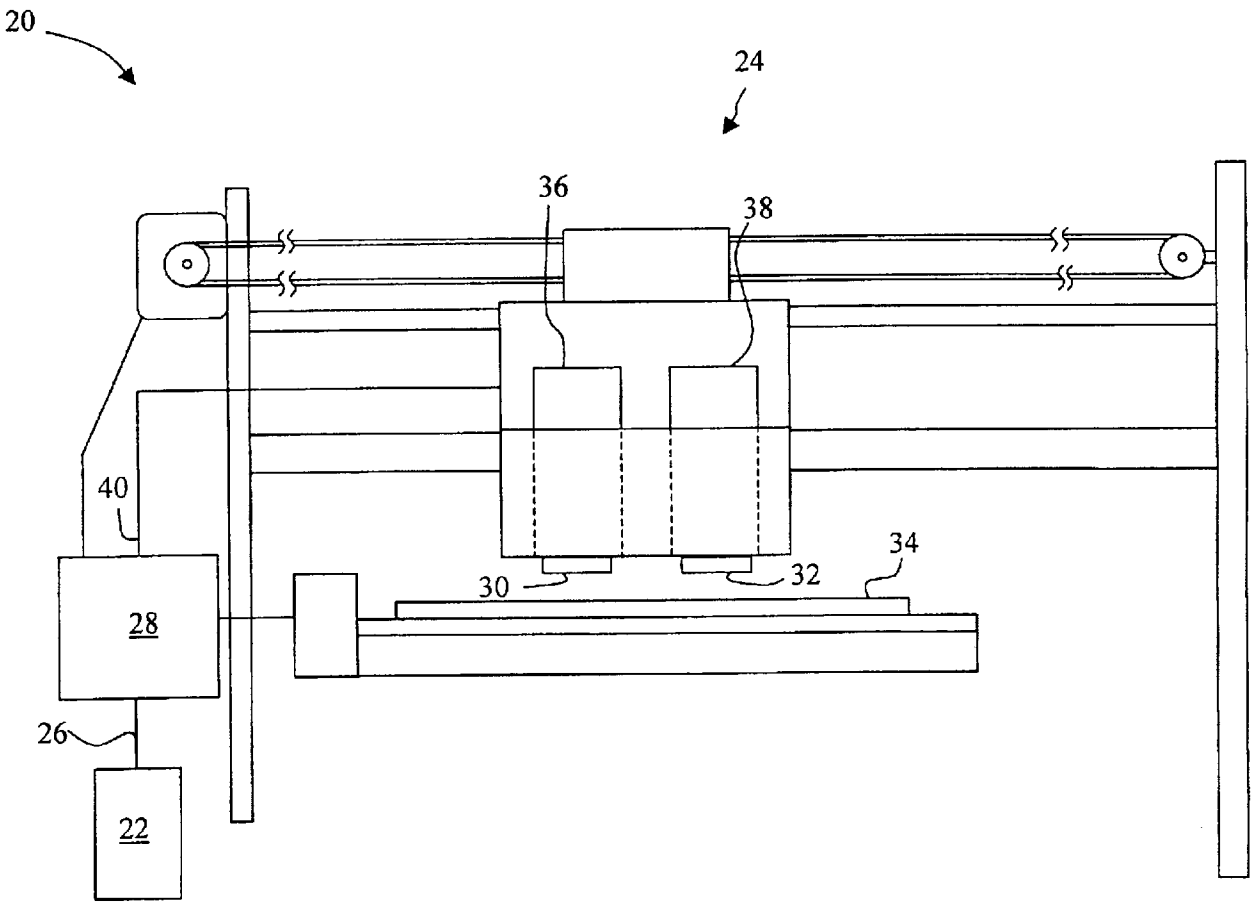
FIG. 1 is a diagrammatic representation of an imaging apparatus in which the output of the present invention may be used.

Referring now to the drawings and particularly to FIG. 1, there is shown an imaging apparatus 20 embodying the present invention. Imaging apparatus 20 includes a computer 22 and an imaging device in the form of an ink jet printer 24. Computer 22 is communicatively coupled to ink jet printer 24 via a communications link 26. Communications link 26 may be, for example, a direct electrical or optical connection, or a network connection.

Computer 22 is typical of that known in the art, and includes a display, input devices such as a mouse and/or a keyboard, a processor, and associated memory. Resident in the memory of computer 22 is printer driver software. The printer driver software places print data and print commands in a format that can be recognized by ink jet printer 24, and includes printer profile data that is used to generate color output.

Reference to primary colors of inks capable of being printed by ink jet printer 24 include cyan, designated as "C," magenta, designated as "M," yellow, designated as "Y," and black, designated as "K."

Ink jet printer 24 includes a controller 28, a CMY printhead 30, and a KCM printhead 32, for printing on a recording medium 34. A CMY ink jet reservoir 36 is provided in fluid communication with CMY printhead 30, and a KCM ink reservoir 38 is provided in fluid communication with KCM printhead 32.

Controller 28 is electrically connected to CMY printhead 30 and KCM printhead 32 via an interface cable 40.

Controller 28 includes a microprocessor having an associated random access memory (RAM) and read only memory (ROM). Controller 28 executes program instructions to effect the printing of an image on the sheet of recording medium 34, such as coated paper, plain paper, photo paper, or transparency. Controller 28 works in conjunction with printer driver software to define a printer profile that includes a color gamut with all the color combinations that may be printed by ink jet printer 24.

CMY printhead 30 is capable of printing various colors of ink from color ink jet reservoir 36, which includes cyan, magenta, and yellow saturated inks. CMY printhead 30 is also capable of printing at least two drop sizes, or drop masses, of ink, including a large drop mass and a small drop mass.

KCM printhead 32 is capable of printing black, cyan, and magenta inks from KCM ink jet reservoir 38, in diluted cyan and magenta, and diluted and/or saturated black, as well as printing at least two drop sizes, or drop masses, of ink, including a large drop mass and a small drop mass.

Accordingly, ink jet printer 24 may be referred to as a multilevel CMYK printer. The term "multilevel" pertains to the ability to selectively print with more than one printing level. Each printing level is defined by an ink concentration, e.g. saturated or diluted, and a drop mass, e.g. a large drop or a small drop. Thus, together the CMY printhead 30 and KCM printhead 32 include four printing levels, namely diluted small drop; diluted large drop; saturated small drop; and saturated large drop.

Multilevel ink jet printer 24 can selectively print any combination of these four printing levels from each primary color ink, including selectively printing with both diluted and saturated inks, and selectively applying small and large drop masses to recording medium 34. Thus, each of the CMYK primary color inks are multilevel primary color inks. The term "multilevel primary color ink" is used herein to refer to a primary color ink available for printing at multiple printing levels.

Figure 2A:
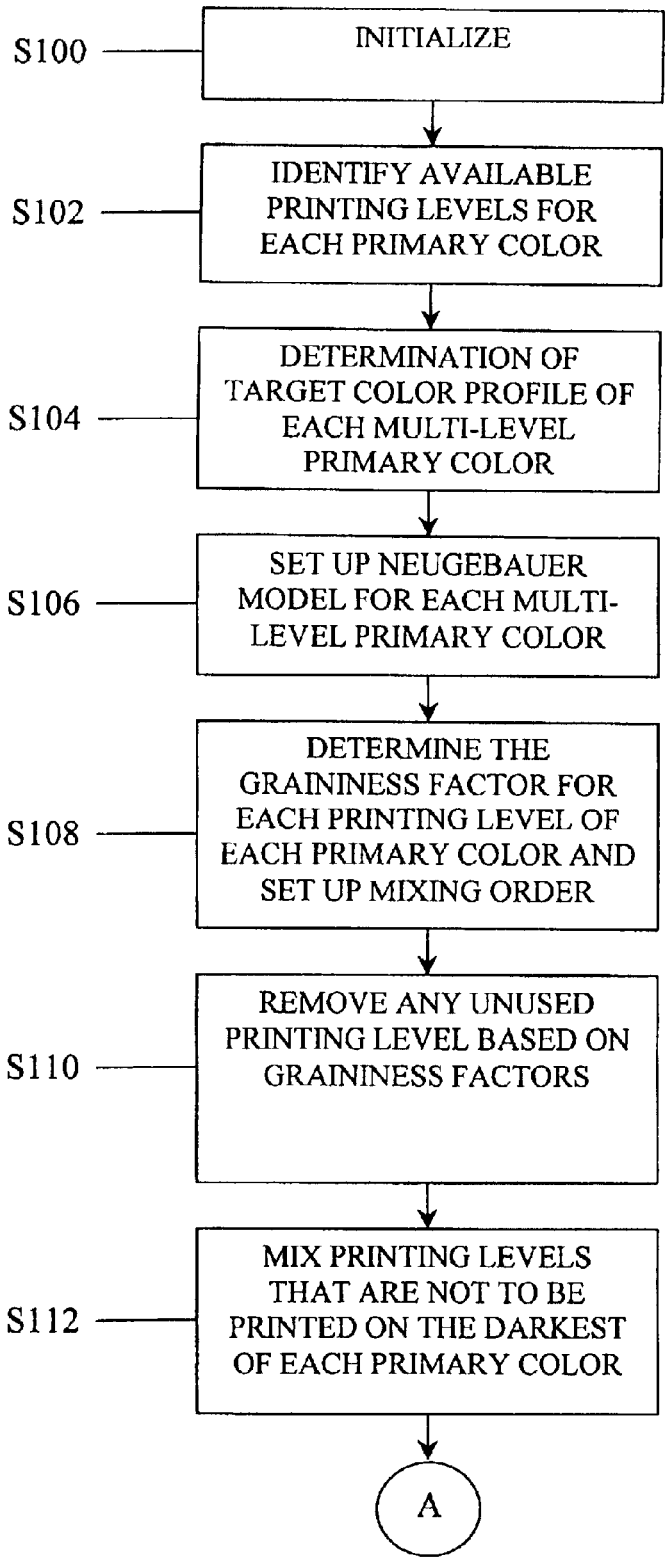
FIGS. 2A, 2B and 2C together form a flowchart depicting the method steps of an embodiment of the present invention.
Figure 2B:
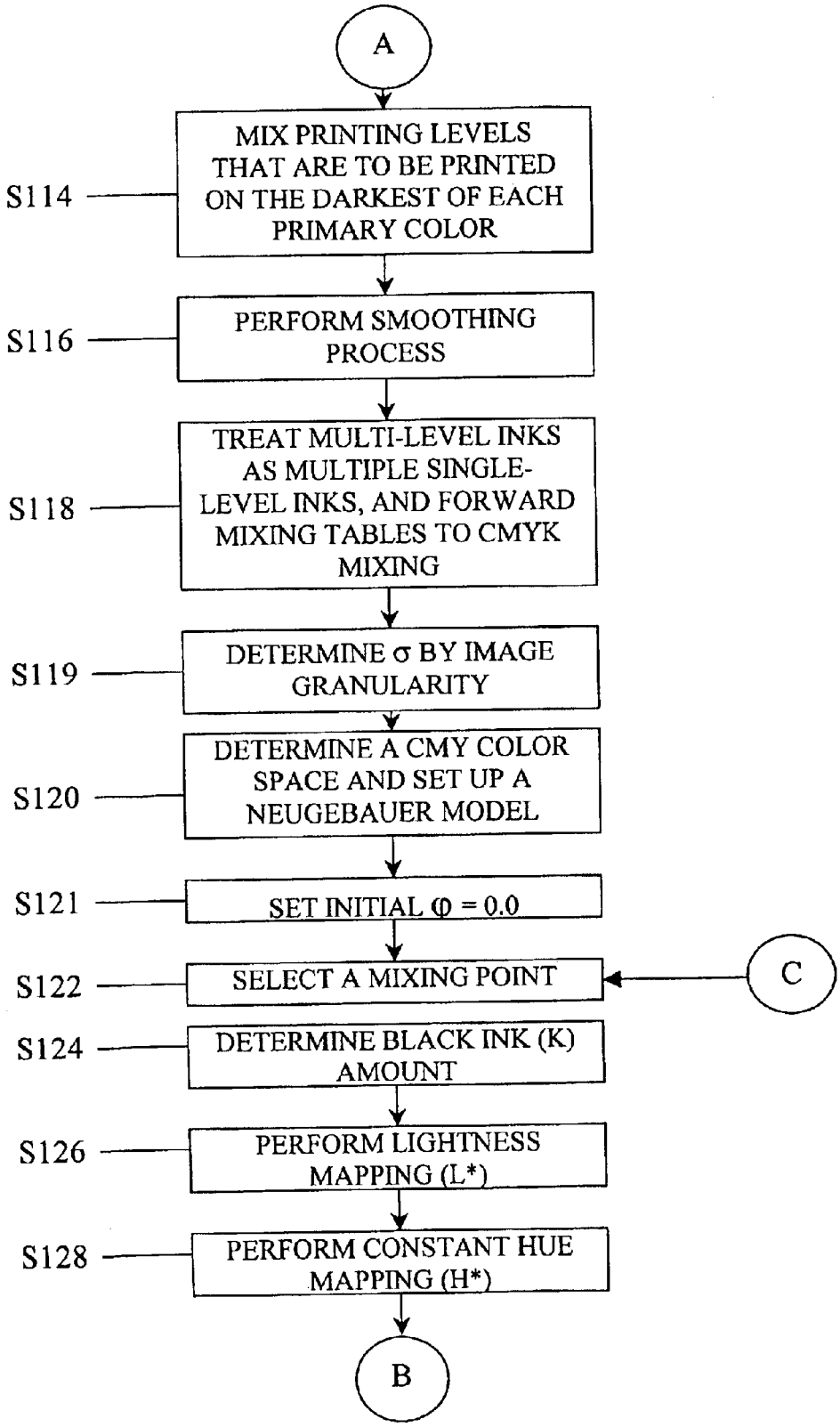
Figure 2C:
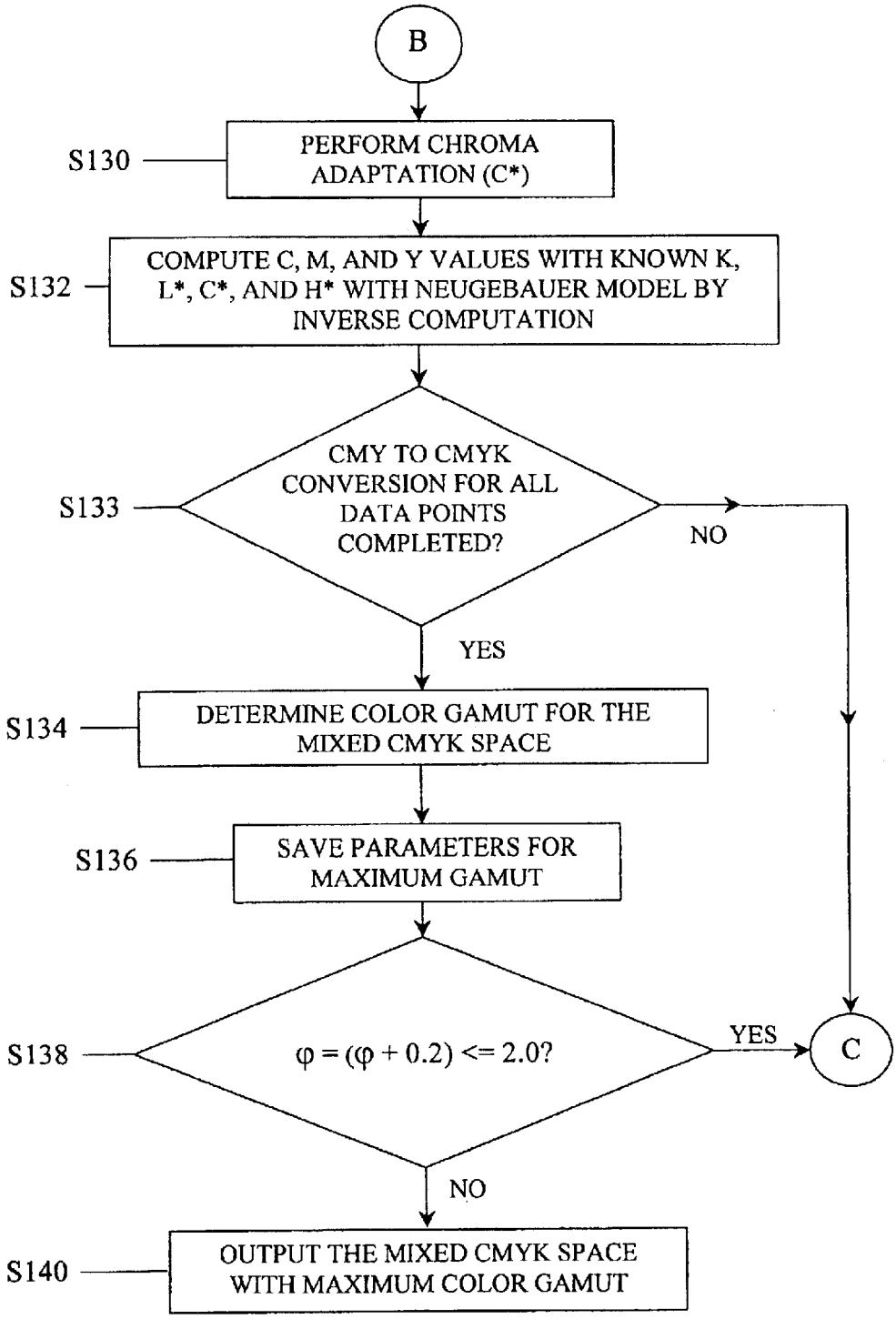

Referring now to FIGS. 2A, 2B, and 2C, there is shown a flowchart depicting the method steps of an embodiment of the present invention in which the mixing method obtains a maximized gamut which is closest to the full gamut while removing the appropriate process black. The steps depicted in FIGS. 2A–2C may be summarized into five general procedures as follows: (1) steps S100–S104, the determination of a target color profile for each primary color (cyan, magenta, yellow, or black), (2) steps S106–S118, generation of mixing tables of different printing levels for each primary color, (3) step S124, black ink computation, (4) steps S119–S122 and S126–S136, mixing process, and (5) an optimization process repeating steps S122–S138, and step S140.

In the interest of simplicity, most of the invention is described with respect to a single color, cyan, having a reference designation, C, to which various subscripts or superscripts may be added, yielding reference designations, such as $C_0$, $C_0'$, $C_{00i}'$, $C_{01i}'$, etc., which are explained during the course of the description of the invention. It is to be understood that the descriptions with regard to the color, cyan, are equally applicable to the other colors used by the multilevel printing system, and the use of cyan is exemplary, and not intended to limit the scope of the present invention. Thus, the primary reference designations used for cyan may be adopted for magenta, yellow, and black.

A general principle of the invention is that the different printing levels of a primary color ink are first mixed to produce the target color profile. No matter how many printing levels a primary color ink has, a single target color profile can be created by appropriately mixing its different levels. Accordingly four different target color profiles of C, M, Y, and K are developed. Then, a black mixing method is applied to the four target colors.

Referring now to FIG. 2A, the present invention is set forth as follows. At step S100, the method of the present invention is initialized. The initialization process is typical, and includes setting all parameters to predetermined initial values.

At step S102, the available printing levels for each primary color are identified. Although each primary color may have multiple levels, for example, four levels including both diluted and saturated inks, and small and large drop masses for both diluted and saturated inks, only some of the possible printing levels may be desirable for use by ink jet printer 24, or available in other ink jet printers. For example, although many levels of black may be possible, generally, diluted levels of black are not used, and thus only the saturated printing levels of black may be desirable, or available, by the particular ink jet printer being considered.

At step S104, the target color profile of each multilevel primary color is determined.

Figure 3:
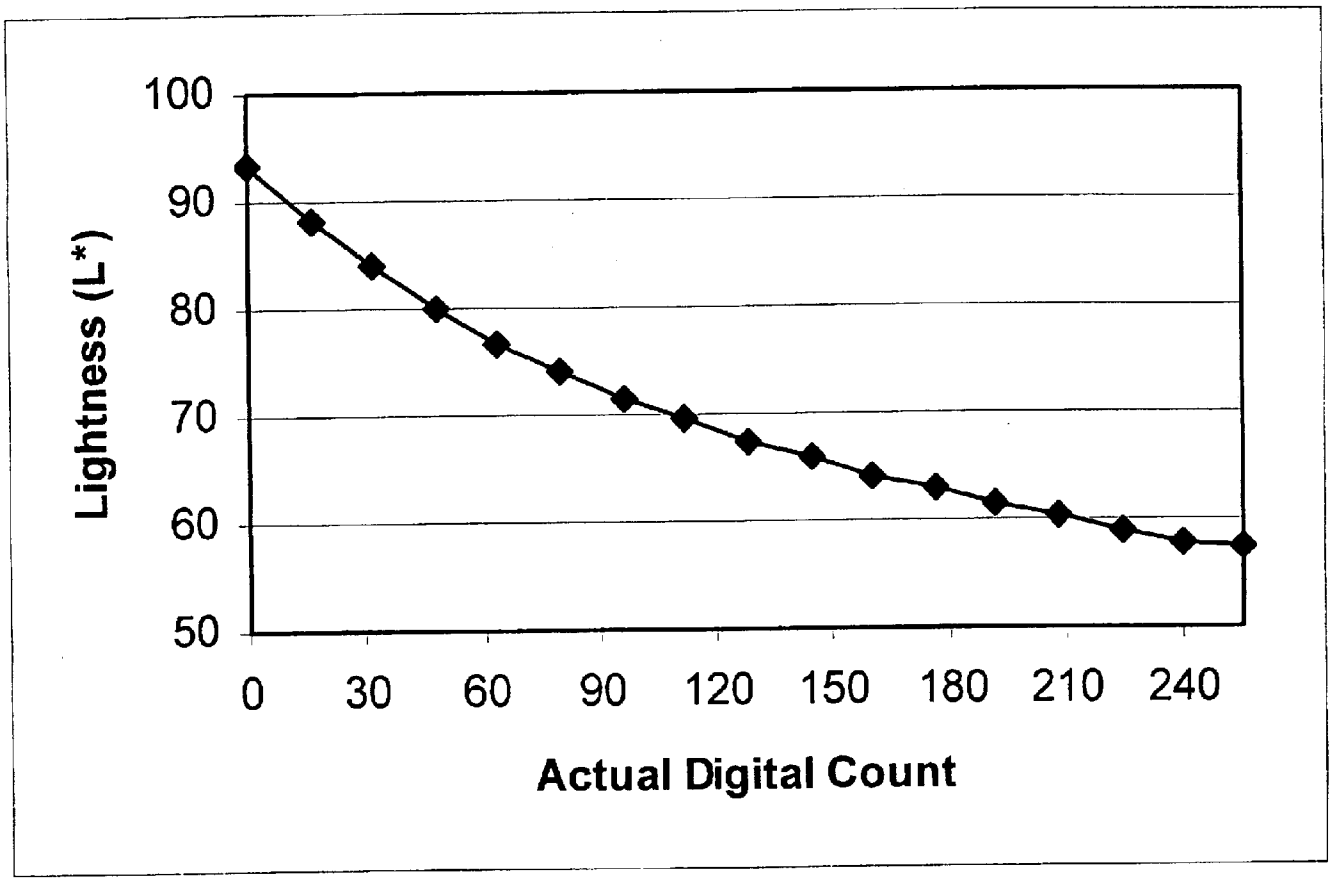
FIG. 3 is a lightness L* profile formed by plotting the change of lightness (L*) relative to an actual digital count, $C_0'$, of a primary color, single printing level ink, shown for cyan.

Referring now to FIG. 3, the change of lightness L* with the actual digital count, $C_0'$, referred to as a lightness L* profile, of a primary color ink having a single printing level is depicted. As may be appreciated by those skilled in the art, L* is a measure of lightness in the CIELAB color space system. FIG. 3 is empirically determined by measuring the lightness L* for actual digital count $C_0'$ values between zero and 255. The actual digital count is that digital count which is sent directly to the printer during printing operations. The color of the paper, e.g., paper white, is set at digital count=0, and the solid color, here the darkest cyan color, is set at digital count =255, which is the maximum value for 8-bit representation. It can be seen in FIG. 3 that the change of lightness L* with respect to the actual digital count is non-linear. Although FIG. 3 depicts the color, cyan, other colors exhibit similar behavior, and the use of cyan in FIG. 3 is exemplary and is not intended to limit the scope of the present invention.

Since a more linearized color space would result in less interpolation errors in later processing, a digital count lookup table is constructed in accordance with FIGS. 4 and 5. The lookup table includes a table index of a nominal digital count, $C_0$, and a table content of actual digital count, $C_0'$. Nominal digital count, $C_0$, is the value used by the method of the present invention in mixing black ink and color inks for the multi-level printing system. The lookup table is constructed in such a way that when the nominal digital count changes from 0 to 255, the actual digital count, $C_0'$, changes non-linearly from 0 to 255, in order to render the change of lightness L* is linear from the white point to the darkest point with respect to nominal digital count $C_0$. The lookup table may be represented graphically, as in FIGS. 4 and 5, discussed below, and is constructed for each of the primary colors, cyan, magenta, yellow, and black.

Figure 4:
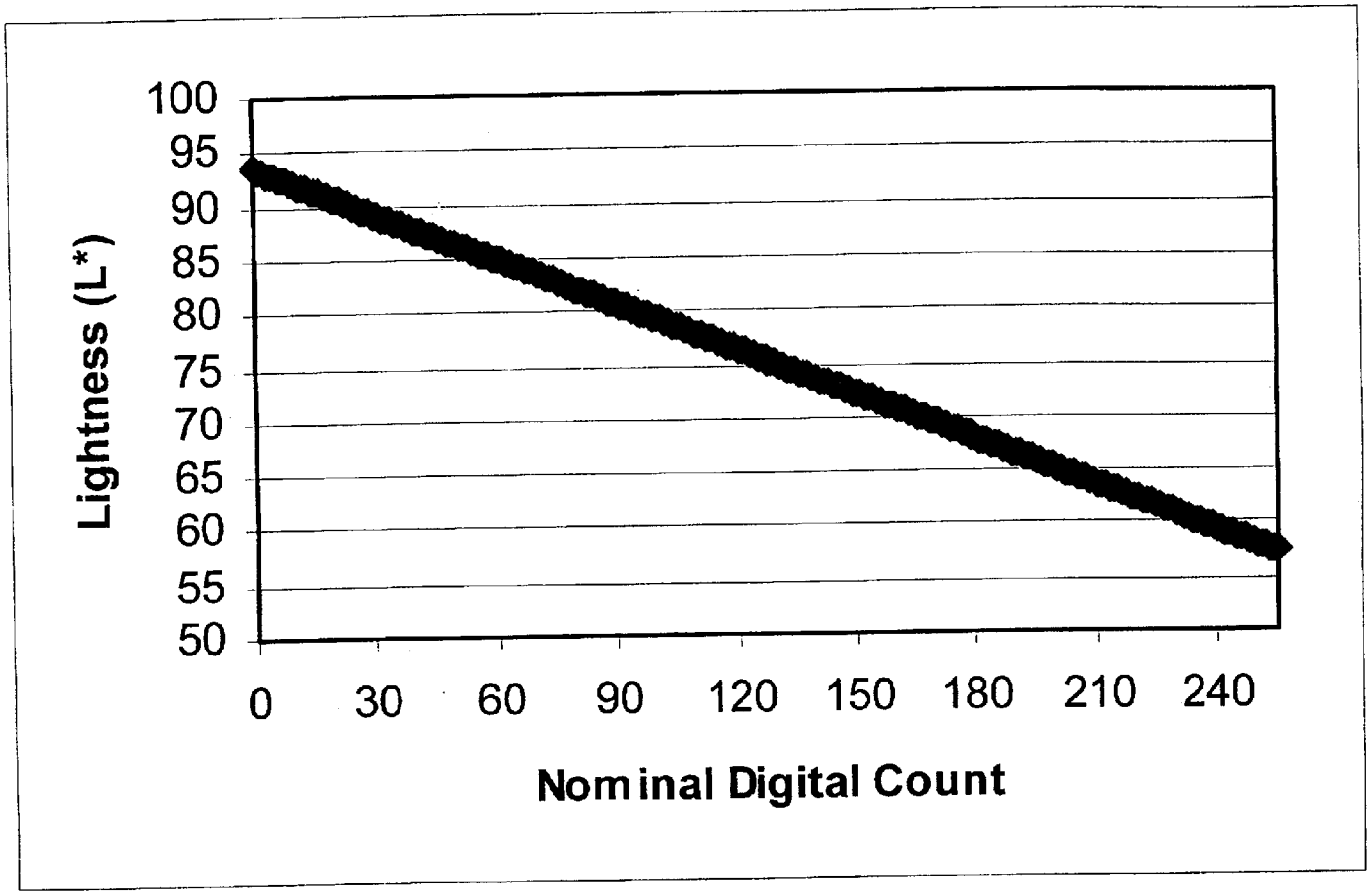
FIG. 4 is a linearized lightness L* profile formed by plotting the change in lightness L* with respect to a nominal digital count for cyan in accordance with the present invention, and also referred to as a target color profile for cyan.

Referring now to FIG. 4, a plot depicting change in lightness L* with respect to nominal digital count, referred to as a linearized lightness L* profile, is illustrated. FIG. 4 may be constructed by taking the plot of FIG. 3, and drawing a line between the maximum lightness L* value to the minimum lightness L* value, and changing the title of the abscissa to "Nominal Digital Count." The linearized lightness profile with respect to the nominal digital count $C_0$ defines a "target color profile" that is used by the method of the present invention in mixing the primary ink colors. In order to determine this profile, the lightness L* of paper white and that of the darkest (solid) color, (e.g., nominal digital count $C_0$=actual digital count $C_0'$=255) as printed on the paper, is required, as these lightness L* values depend at least partially on the particular recording medium 34 used. Here, those values were obtained empirically in creating the plot of FIG. 3, from which the plot of FIG. 4 was derived. For example, in both FIGS. 3 and 4, it is seen that the maximum lightness L* value is approximately 94, occurring at nominal digital count $C_0$=actual digital count $C_0'$=0, which corresponds to paper white for the particular recording medium 34 used in generating FIG. 3. In addition, it is seen that the minimum lightness L* value is approximately 57, occurring at nominal digital count $C_0$=actual digital count $C_0'$=255, which corresponds to the darkest, i.e., solid, printing of the color cyan on the particular recording medium 34 used.

For the target color profile of a multilevel ink, those levels of the ink that can be printed on the darkest color also must be known, and can vary from one printing system to another. The general rule is that the diluted levels, i.e., diluted small drops and diluted large drops, will not be printed over the darkest color, i.e., the color with the highest amount of saturation, but saturated small dots may be printed on the darkest in addition to the saturated large dots. In FIG. 4, the target color profile of cyan ink includes a darkest point having 100% saturated small dots and 100% saturated large dots printed on recording medium 34.

Figure 5:
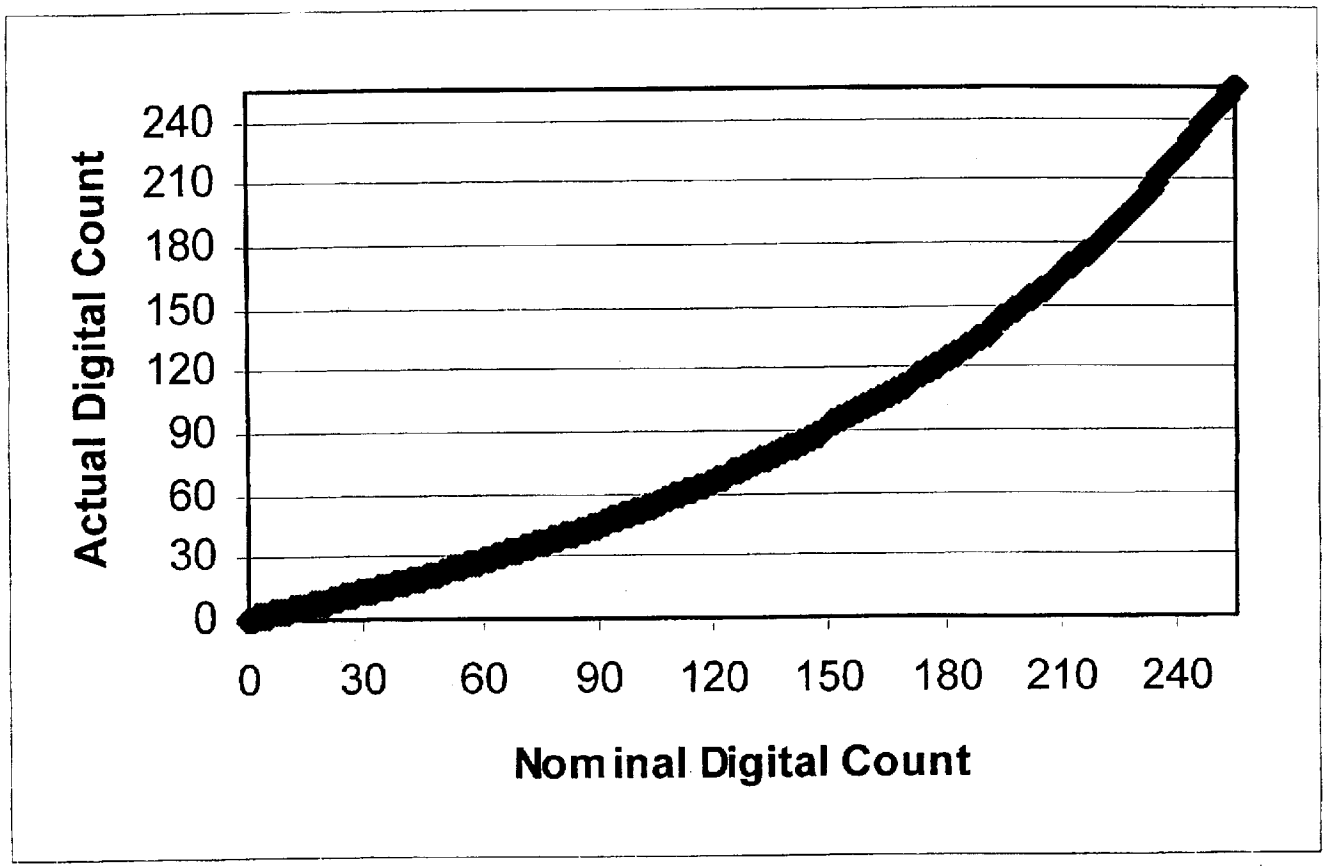
FIG. 5 is a plot depicting the relationship of the nominal digital count with the actual digital count in accordance with the present invention.

The plot of FIG. 4 is used to generate the plot of FIG. 5 by determining which actual digital count values are necessary to produce the linearized lightness L* profile of FIG. 4.

Referring now to FIG. 5, a plot depicting the relationship of a nominal digital count with a corresponding actual digital count is shown. In using the plot of FIG. 5, a value for the nominal digital count is selected on the abscissa, and the associated value of the actual digital count $C_0'$ is read as the corresponding value on the ordinate. For example, a nominal digital count $C_0$ value of 120 yields an actual digital count $C_0'$ value of approximately 65.

Accordingly, by virtue of the lookup table of the present invention, exemplified in FIGS. 4 and 5, a lightness L* value can be determined from a nominal digital count value. Once FIGS. 4 and 5 have been generated for each primary color ink, they are used by the method of the present invention in creating mixing tables for each primary color ink, such as that exemplified in FIG. 6.

The nominal count value for each color is used in conjunction with the target color profile exemplified in FIG. 4, and the values selected for printing are based on the relationship between nominal digital count $C_0$ and actual digital count $C_0'$, exemplified in FIG. 5 for the color, cyan, as printed on the particular recording medium 34. For example, from FIG. 5, a nominal digital count $C_0$ value of 120 would yield a lightness L* value of approximately 77, which would be used by the method of the present invention in the color mixing steps. In printing operations, the nominal digital count $C_0$ value of 120 would be converted to an actual digital count $C_0'$ value of approximately 65, which would be sent to the printer in order to realize a lightness L* value of approximately 77.

Figure 6:
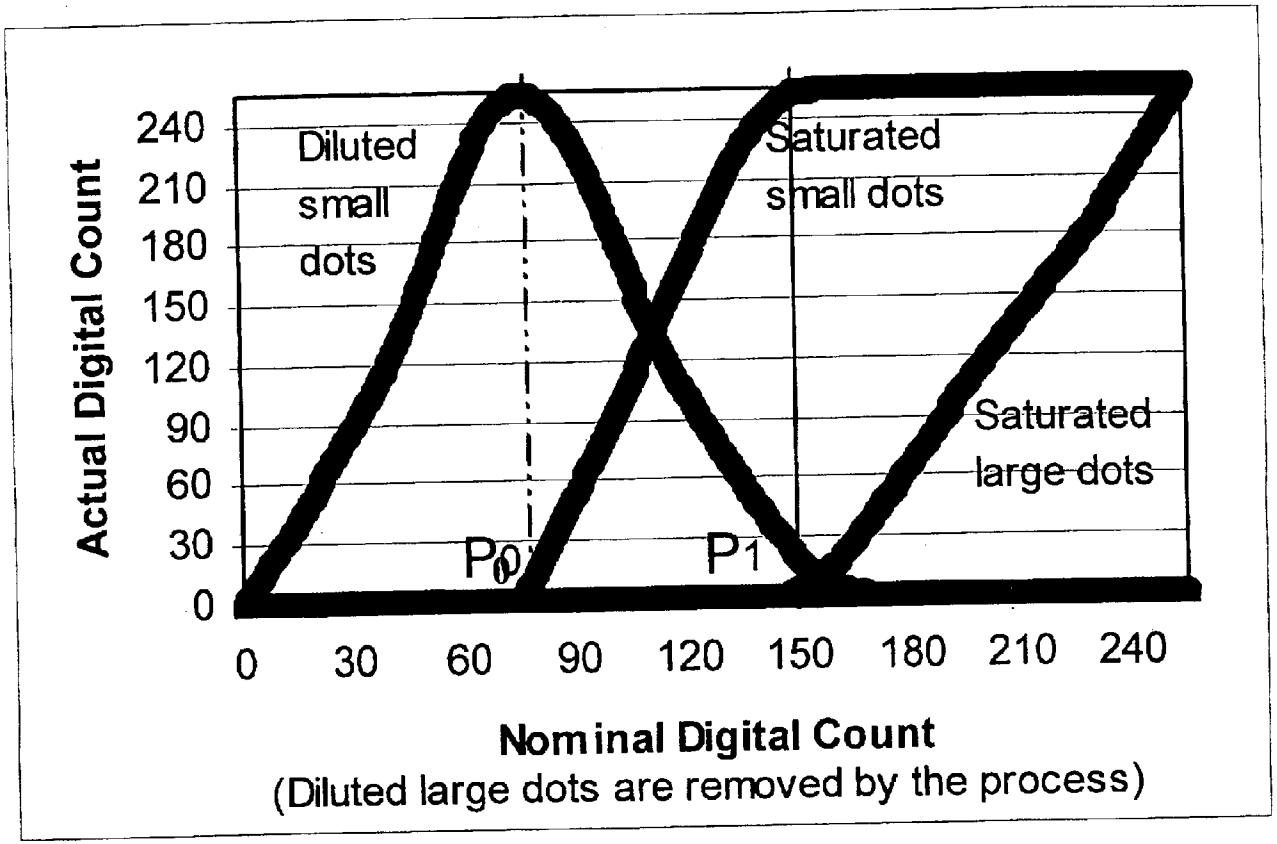
FIG. 6 depicts an example of smoothed mixing tables of cyan ink with three different printing levels selected.

Referring now to FIG. 6, an example of the mixing table of cyan ink with four different printing levels is depicted. For each table index (nominal digital count $C_{01}$), we can find a combination of the four printing levels' actual digital counts, $C_{00i}'$, $C_{01i}'$, $C_{02i}'$, and $C_{03i}'$, which correspond to diluted small dot, diluted large dot, saturated small dot, and saturated large dot, respectively. This combination together will produce the target color value at the nominal digital count $C_0$. The mixing tables of FIG. 6 are generated by the following procedures.

Referring back to FIG. 2A, at step S106, a Neugebauer model is set up for each multi-level primary color, wherein each primary color has N printing levels. In order to obtain a target color profile, color values of any combinations of the N different levels must be known. To this end, a Neugebauer model can be used. As may be appreciated by those skilled in the art, the Neugebauer model, based on the equations developed by Hans Neugebauer and modified by others, may be used to convert between the CIELAB device-independent color space and the device-dependent CMYK color space. By this model, the CIELAB color values (L*, a*, b*) can be computed for any combination point based on certain measurements. L* is a measure of lightness, a* is a red-green axis, and b* is a yellow-blue axis, in the CIELAB color space.

Each level of each primary color ink is sampled at 17 points evenly spaced over the range from 0% to 100% ink. For a 4-level ink, a total of 68 patches are prepared for measuring the color values with a spectrophotometer.

Each Neugebauer primary color is one of all combinations of all printing levels of the ink with each level having two sampling points: 0% and 100% ink. Thus, a total of $2^N$ (16 for N=4 printing levels) Neugebauer primary color patches is measured.

At step S108, the graininess factor for each printing level of each primary color ink is determined, and the mixing order is set up. Preferably, the graininess factor is a relative graininess factor (RGF).

The mixing order is set up based on mixing rules, described below, for mixing different printing levels, and include a determination of the relative graininess factor.

Rule 1: The mixing order is arranged as proceeding from the lightest color of each primary color ink to the darkest color of each primary color ink, for example, where the lightest color is that designated by a digital count closest to zero, and the darkest color is that designated by a digital count closest to or at the maximum of 255. From light to dark color, the less grainy level of ink is used or introduced first, before the more grainy level of ink is used or introduced. Thus, the less grainy levels of ink would be associated with lower digital counts than more grainy levels of ink. This is because the lighter color has fewer dots and would look grainier than the darker color when the same printing level of ink is used. Accordingly, the mixing order proceeds from the less grainy printing levels to the more grainy printing levels.

Among the printing levels of a primary color ink, a relative graininess factor (RGF), g, for a printing level of ink can be approximately estimated as follows:

$$g = \frac{d^2}{nq} \qquad \text{(Equation 1)}$$

where, d is the dot diameter; n is the number of dots printed per image input pixel supplied to ink jet printer 24 (for example, when printing a solid color of 1 $in^2$ with a 600 dpi printer, n=1 if the total dot counts are 360,000 for 600 dot×600 dot image, and n=2 if they are 720,000 (2×600×600) for a 600 dot by 600 dot image—different printing levels may have different values of n), and q is the actual digital count which is determined under the same L* for all of the printing levels of a primary color ink. This L* value is chosen as the lightest solid color among the printing levels. The smaller value of relative graininess factor, the lower the printing level will be in the mixing order, e.g., the printing level with the lowest relative graininess factor will be first in the mixing order.

Rule 2: The second rule is that a diluted level is not used for printing if its relative graininess factor is larger than any saturated level. This may happen in a printing system with different ink concentrations and drop masses. For example, the diluted large dots may have a larger relative graininess factor than the saturated small dots. The diluted ink has more water than the saturated ink and hence it should not be used if it could not improve the graininess.

Rule 3: The third rule is that the diluted level should not be printed on the darkest color. This is because adding diluted ink on the darkest color would not improve the graininess.

The relative graininess factors are determined, and the mixing order is set up according to Rules 1–3, above, as illustrated in the following example.

Figure 7:
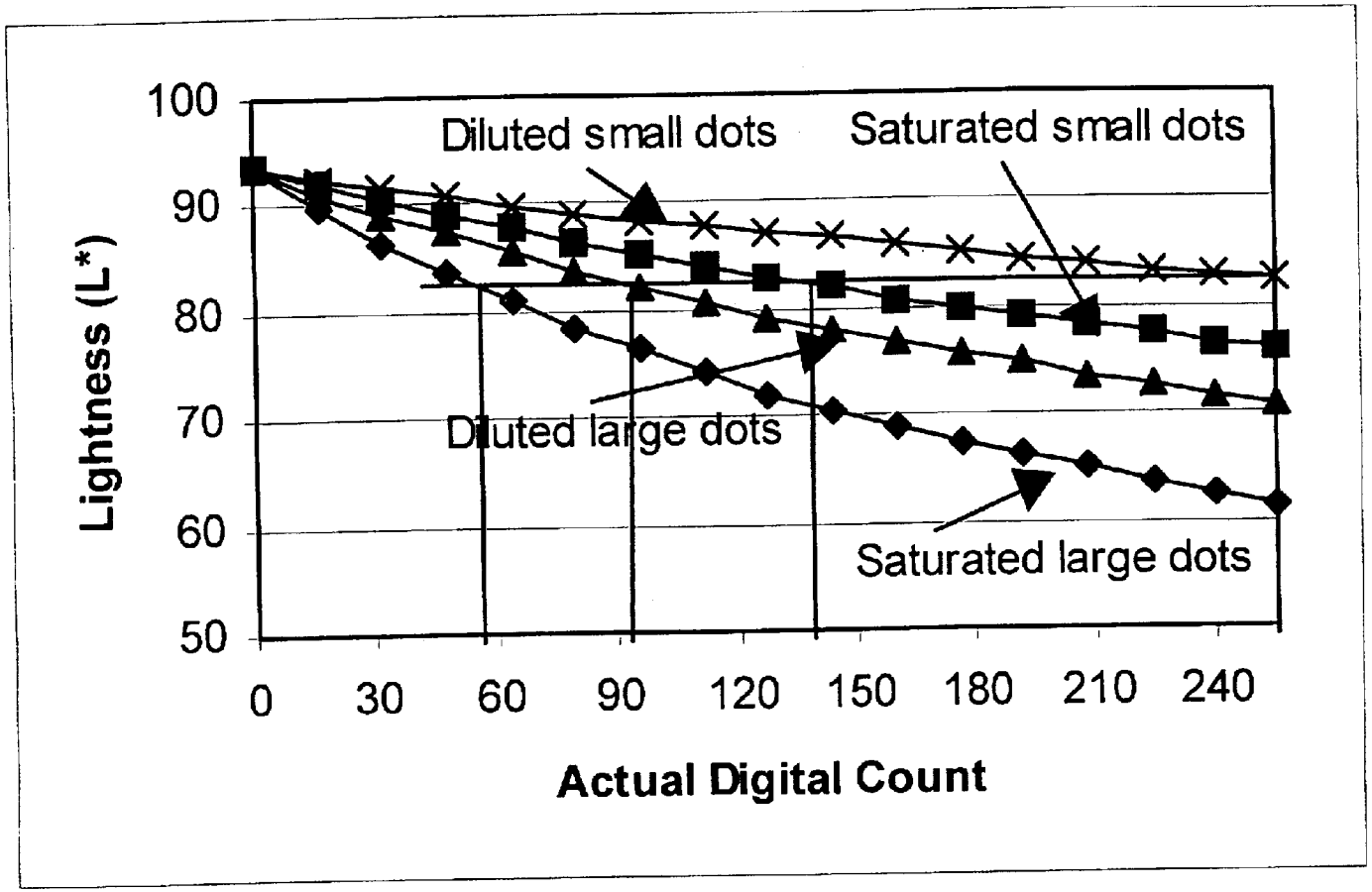
FIG. 7 depicts the lightness L* profiles of 4-level cyan obtained from area coverage measurements.
Figure 8:
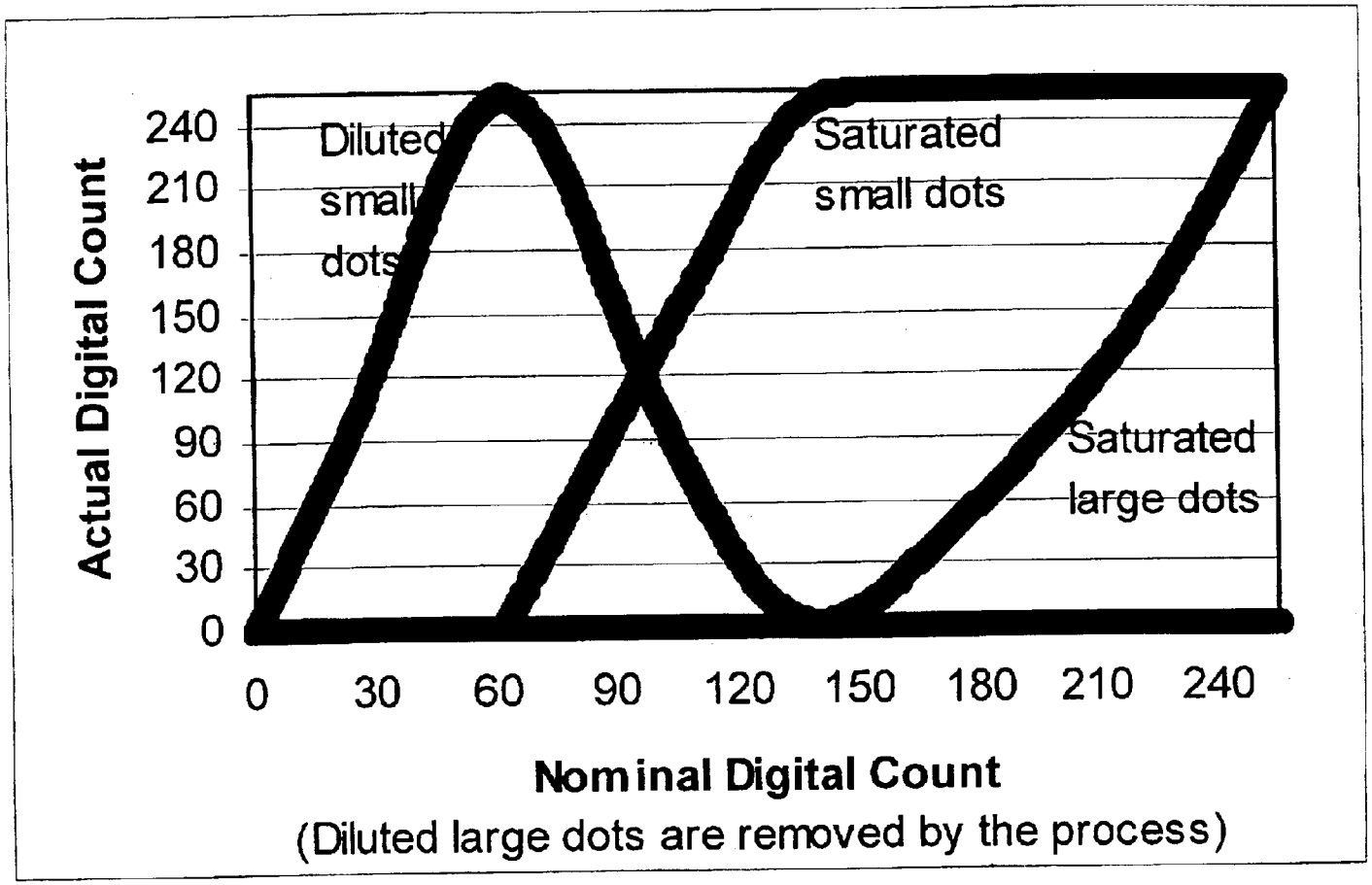
FIG. 8 depicts an example of smoothed mixing tables of magenta ink with three different printing levels selected.
Figure 9:
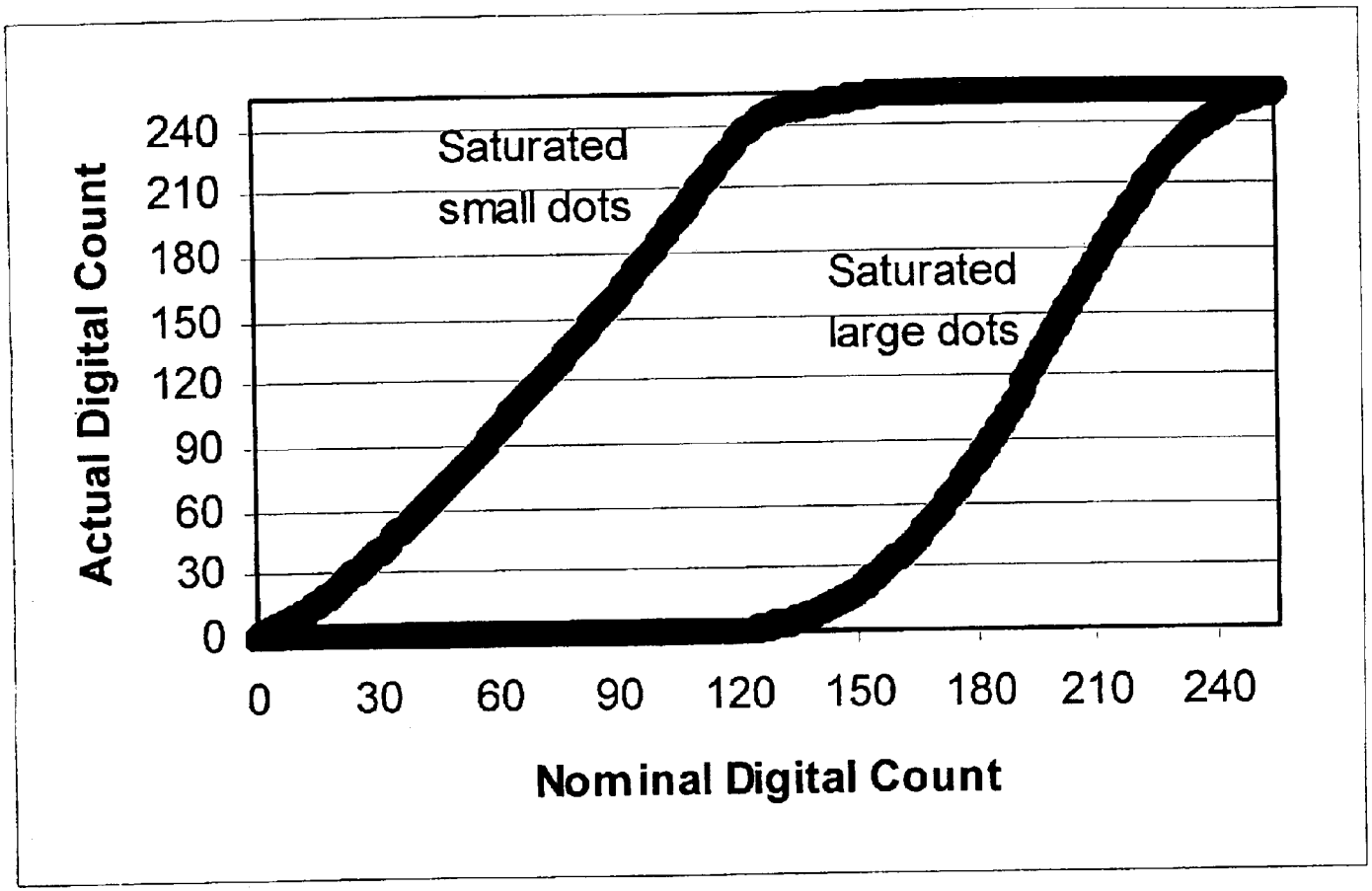
FIG. 9 depicts an example of smoothed mixing tables of yellow ink with two different printing levels selected.
Figure 10:
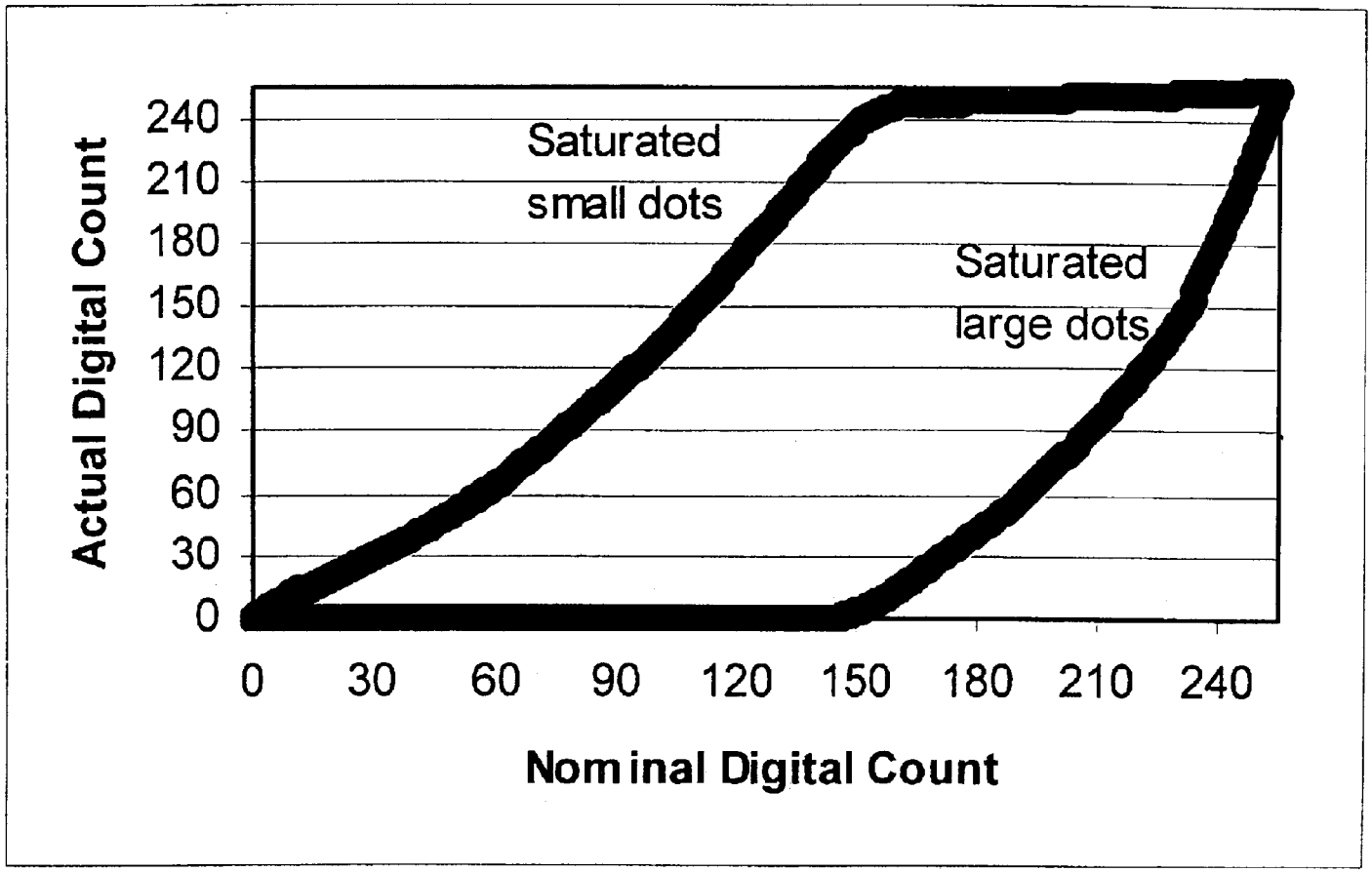
FIG. 10 depicts an example of smoothed mixing tables of black ink with two different printing levels selected.

Referring now to FIG. 7, the lightness profiles of 4-level cyan that are from the area coverage measurements, determined above, is depicted. The lightest solid color is the diluted small dots having a maximum lightness L* of approximately 82. Under this L* value, the actual digital counts are $q_{00}'=255$, $q_{01}'=92$, $q_{02}'=138$, $q_{03}'=55$ for diluted small dot, diluted large dot, saturated small dot, and saturated large dot, respectively. The measured dot diameters are $d_{00}=35.0$, $d_{01}=51.0$, $d_{02}=35.0$, $d_{03}=51.0$, measured in micro millimeters (nanometers). The number of printed dots per image input pixel supplied to imaging apparatus 20, n, equals 1 for all levels. Thus, the relative graininess factors obtained via Equation 1 are $g_{00}=4.8$, $g_{01}=28.3$, $g_{02}=8.9$, $g_{03}=47.3$. Therefore, in accordance with Rule 1, above, the mixing order from light color to dark color will be: (1) diluted small dots; followed by (2) saturated small dots; followed by (3) diluted large dots; followed by (4) saturated large dots.

Referring back to FIG. 2A, at step S110, any unused printing levels are removed if necessary, based on the relative graininess factors, and based on the application of Rules 1–3, above. Continuing the example set forth above, in accordance with Rule 2, the diluted large dots of cyan will not be used since it has larger relative graininess factor than the saturated small dots. Thus the diluted larges dots of cyan are an unused printing level of cyan. The modified mixing order from light color to dark color is therefore: (1) diluted small dots; followed by (2) saturated small dots; followed by (3) saturated large dots.

At step S112, the printing levels that are not to be printed on the darkest of each primary color (saturated), based on Rule 3, are mixed. The objective of mixing different printing levels is, for a given target color profile index (nominal digital count $C_{0i}$), to find an appropriate combination of the levels to produce the desired lightness L* at the index. This combination is found according to the following mixing sequence.

As an initial mixing sequence step, all mixing tables are set to zeros.

In the second mixing sequence step, the first level which is not printed on the darkest color in the mixing order (here it is the diluted small dots) is selected and at from the white point (digital count index=0) in the target color profile, that target lightness L* is found.

Then, in the third mixing sequence step, the target color profile index is increased by 1 and the target lightness L* is found.

In the fourth mixing sequence step, only the currently selected level's actual digital count are changed and other levels' actual digital counts are kept unchanged. The Neugebauer model and all levels' actual digital counts are used at the current target index to compute the lightness value until matching the target L*. The matched actual digital count are put in the current level's lookup table.

In the fifth mixing sequence step, the third and fourth mixing sequence steps are repeated until the matched actual digital count reaches the maximum value of 255.

Referring again to FIG. 6, the left part of the vertical dash-dot-dot line seen is the mixing result obtained thus far for the diluted small dots. The current target profile index (corresponding to the peak) is recorded as the peak index ($P_0$ in FIG. 6).

Next, in the sixth mixing sequence step, the left part is flipped to the right side of the vertical dot-line. In other words, the portion of the diluted small dot curve on the left side of the dash-dot-dot line is mirrored to the right side of that line, as was done in generating FIG. 6. If the mirrored part extends beyond the maximum index (nominal digital count of 255), it is linearly scaled to the maximum index.

In the seventh mixing sequence step, the next level, if any, is selected which is not printed on the darkest color. The target profile is continued from the last value of peak index $P_0$. The third through sixth mixing sequence steps are repeated for each printing level that is not to be printed on the darkest of each primary color, with each level starting from the previous value of peak index.

Following step S112, at step S114 of FIG. 2B, the printing levels that are to be printed on the darkest of each primary color (saturated), based on Rule 3, are mixed. The mixing sequence is similar to the above mixing sequence, and is as follows:

Initially, the first level which is printed on the darkest color in the mixing order (here it is the saturated small dots) is selected. Starting from the last "peak index" in the target color profile obtained above, the white point (digital count= 0) for the selected level is inserted into the mixing table at an L* value corresponding to the white point.

In the second mixing sequence step, the target color profile index is increased by 1 and the target L* is found.

Next, in the third mixing sequence step, only the currently selected level's actual digital count are changed, and other levels' actual digital counts are kept unchanged. The Neugebauer model and all levels' actual digital counts at the current target index are used to compute the lightness value until the target L* is matched. The matched actual digital count is then put in the current level's lookup table.

In the fourth mixing sequence step, the preceding steps are repeated until the matched actual digital count reaches the maximum value (255), or until the target color profile index reaches the maximum value (255), whichever comes first. The current target profile index is recorded as the peak index $P_1$, illustrated in FIG. 6.

Next, in the fifth mixing sequence step, if the peak index $P_1$ is smaller than the maximum value, the currently selected level's table contents will be keep constant from peak index $P_1$ to the maximum index. If the peak index $P_1$ has reached the maximum value, the mixing process will be completed.

In the sixth mixing sequence step, the next level (here it is the saturated large dots), if any, is selected which is printed on the darkest color. The target profile is continued from the last peak index, $P_1$. The second through fifth mixing sequence steps are repeated for each printing level that is to be printed on the darkest of each primary color.

The results of the mixing steps S112 and S114 yield a plurality of mixing tables, that is, at least one mixing table for each multilevel primary color ink.

At step 116, the smoothing process is performed on the mixing tables. Since the mixing tables are determined based on a series of model data measurements, noise in the measurement data may be propagated into the mixing tables. Thus, a running-average scheme is employed to smooth the table. A run-length of 11 points has been found suitable for this purpose. That is, for each point in the mixing tables of each printing level, the original point is replaced with an average of 5 points to the left of the original point, the original point itself, and the 5 points to the right of the original point.

Referring now to FIGS. 6 and 8–10, smoothed mixing tables of cyan, magenta, yellow, and black are illustrated. Because more than one printing level is mixed into each mixing table, each mixing table may be referred to as a multilevel mixing table.

Referring again to FIG. 2B, at step S118, after the multi-level mixing tables have been generated, the multi-level primary color inks are treated as if they are four "single-level" CMYK inks, each of which has a linearized lightness profile and has a nominal digital count ranging from 0 to 255, and the mixing tables are forwarded to a CMYK mixing process.

In the following description, the digital counts refer to nominal digital counts unless otherwise specified. The actual digital counts of each printing level of ink can be found from the mixing table using the nominal digital count as the index. The naming convention provides the actual digital count with a superscript (′), for example, $C_0'$, for cyan, and the nominal digital count does not have the superscript, for example, $C_0$, for cyan. The digital counts have a subscript ($_0$) before mixing with black, such as, $C_0$, for cyan in CMY space, and do not have the subscript ($_0$) after mixing with black, for example, C, for cyan in CMYK space.

At step S119, the parameter a is determined by image granularity. The parameter σ determines at what darkness level black ink should start to be introduced in the CMYK mixing process. For example, if a series of patches were printed with $C_0=M_0=Y_0=1, 2, 3, \ldots$, up to 255, and K were determined by the Equations 2–6, below, it would be seen that the larger the values of parameter σ, the more the number of lighter patches that have no black ink. The lighter patches without black ink will have less granularity (less graininess) than patches of the same lightness with black ink. The granularity can be determined by visual examination or by using a granularity instrument if commercially available. The optimum value of parameter σ is that value beyond which there would be no improvement the granularity of any light patches.

At step S120, a CMY color space is determined, and a Neugebauer model is set up for mixing the CMY color space into a mixed CMYK color space. The CMY color space is approximated by values of C, M, and Y, each ranging from 0 to 255, for a total of 256×256×256 equals approximately 1.68 million CMY points in the CMY color space.

The Neugebauer model is used for mixing the plurality of CMY points into a plurality of corresponding mixed CMYK points by converting each CMY point into a corresponding mixed CMYK point to be used for creating a mixed CMYK color space, in which the amount of process black in the CMY point is replaced, at least in part, with an amount of black ink (K) for use in each corresponding mixed CMYK point. Process black is an amount of black color in each of the CMY points that exists without the use of black ink.

At step S121, an initial value of parameter ϕ is set equal to 0.0. Parameter ϕ determines how the black ink amount is distributed over the colorant space, and is determined by an optimization process, to be described following discussion of the process of mixing black ink, below.

At step S122, a mixing point is selected as one of the CMY points from the CMY color space of approximately 1.68 million colors for mixing one of the CMY points into the corresponding CMYK point. A multiple amount of mixing points in selected for generating the mixed CMYK color space in which the process black in the CMY point is replaced, at least in part, with black ink in the corresponding mixed CMYK point. The plurality of mixing points, mixed from CMY points to mixed CMYK points, provides a plurality of mixed CMYK points that are used in creating the mixed CMYK color space At step S124, the amount of black ink is determined. The ultimate determination of black ink amount is part of an iterative optimization process that ends at step S138, depending, as described later, on the value of a parameter $\phi$. Accordingly, steps S122 through S138 are repeated during the optimization process in which the total amount of black ink in the mixed CMYK color space is optimized. Flowchart connector C of FIG. 2B illustrates the return to step S122 from step S138.

The amount of black ink that to be used in a CMYK point corresponding to a CMY point depends on the amount of the process black and the total amount of the color inks in the CMY point. Process black is the darkness produced by the non-black color inks (CMY), and the minimum of the $C_0$, $M_0$, and $Y_0$ values. Generally, the more the amount of process black and/or the more amount of the color inks, the higher amount of black ink should be used to replace process black, but normally not more than the amount of process black. For example, the black ink amount, K, would be less than 65 for the CMY point (65,255,255), in which the process black amount is 65. For two points with about the same process black, e.g., (65, 75, 85) and (65, 255, 255) CMY points, wherein the latter point uses much more ink, owing to the values of 255 for magenta and yellow, more black ink is needed to replace more process black for the darker point, (65, 255, 255), than for the lighter point (65, 75, 85). At least two considerations are involved here. Process black has more dots printed on the paper than the equivalent true black (the ratio is approximately 3 to 1), thus, the process black pattern is less grainy than the equivalent true black pattern. This effect is more dominant for light color than for dark color. Accordingly, more process black should be used for the lighter point. However, using more true black to remove more process black for the darker point (65, 255, 255) can reduce the total amount of inks used in printing the point, and hence reduce the "bleed-through" in the recording medium 34, for example, paper.

In order to implement the aforementioned considerations the following formulas are used to compute the amount of black ink to be used:

$$K = K_{\max}\left[\frac{\mu - \mu_s}{\mu_{\max} - \mu_s}\right]^{\gamma} \quad (K = 0 \text{ if } \mu \le \mu_s) \qquad \text{(Equation 2)}$$

where, $$\mu = min(C_0, M_0, Y_0) \qquad \text{(Equation 3)}$$

and, $$\mu_s = \sigma\left(1 - \frac{1}{k_{\max}}\sqrt{\frac{C_0^2 + M_0^2 + Y_0^2}{3}}\right) \qquad \text{(Equation 4)}$$

$$\gamma = 1 + \varphi K_{\max}\sqrt{\frac{3}{C_0^2 + M_0^2 + Y_0^2}} \qquad \text{(Equation 5)}$$

$$K_{max} = \mu_{max} = 255 \text{ (for 8 bit value)} \qquad \text{(Equation 6)}$$

The meaning of each parameter in Equations 2–6 is as follows:

$C_0$=cyan ink nominal digital count.

$M_0$=magenta ink nominal digital count.

$Y_0$=yellow ink nominal digital count.

K=black ink digital count at a mixing point (P).

$\mu$=minimum color ink digital count at mixing point P.

$\mu_s$=a value of $\mu$ below which no black is used at mixing point P.

$\mu_{max}$=maximum value of $\mu$.

$K_{max}$=maximum black ink digital count.

$\sigma$=a parameter for adjusting $\mu_s$ (15%–25% of $K_{max}$ is recommended).

$\gamma$=a parameter controlling the black ink distribution over the colorant space, wherein the higher value of $\gamma$ will result in less black ink at a mixing point but does not affect the maximum black ink point.

$\phi$=a parameter used to optimize the total amount of black ink in the colorant space, does not change from point to point, and in the iterative optimization process, discussed later, it will vary from 0.0 to 2.0.

The black ink amount is determined for each mixing point. The mixing point is a particular point in the colorant space at which the black digital count K is sought to be determined, and could be any of a combination of $C_0$, $M_0$ and $Y_0$ values, each of which ranges from zero to 255, for a total of approximately 1.68 million points in the CMY color space. However, in practice, a smaller number of points is often used to approximate the CMY color space, such as, for example, 17 values each for $C_0$, $M_0$, and $Y_0$, for a total of 17×17×17=4913 points to be mixed. Typically, some algorithm, for example, interpolation, is then used to estimate the CMY space between and/or around the 4913 mixed points.

The black ink distribution over the colorant space will be smooth because it was determined by smooth analytical equations. In the computation of black ink usage, there are two unknown parameters, $\sigma$ and $\phi$. The parameter $\sigma$ was discussed previously, and the parameter $\phi$ is found during the optimization process of repeating steps S122–S138.

In order to mix the black with CMY color inks, the color values for any combinations of $C_0$, $M_0$, $Y_0$, and K must be known. For this purpose, a Neugebauer model is also be used. By this model, the CIELAB color values (L*, a*, b*) can be computed for any combination point of $C_0$, $M_0$, $Y_0$, and K based on some measurements. These measurements include: measurements of the area coverage of inks and measurements of the Neugebauer primary colors.

Each ink is sampled 17 points evenly spaced over the nominal digital count range from 0% to 100%. For the 4 inks (CMYK), a total of 68 patches are prepared for measuring the color values with a spectrophotometer.

Each Neugebauer primary color is one of all combinations of $C_0$, $M_0$, $Y_0$, and K with each having two sampling points: 0% and 100% ink. A total of $2^N$ (16 for N=4) Neugebauer primary color patches need to be measured.

The available gamut, or volume of color in the L*a*b* colorant space, referred to as the full gamut produced by a given set of inks, can be computed with the Neugebauer model by inputting all possible combinations to the model.

Figure 11:
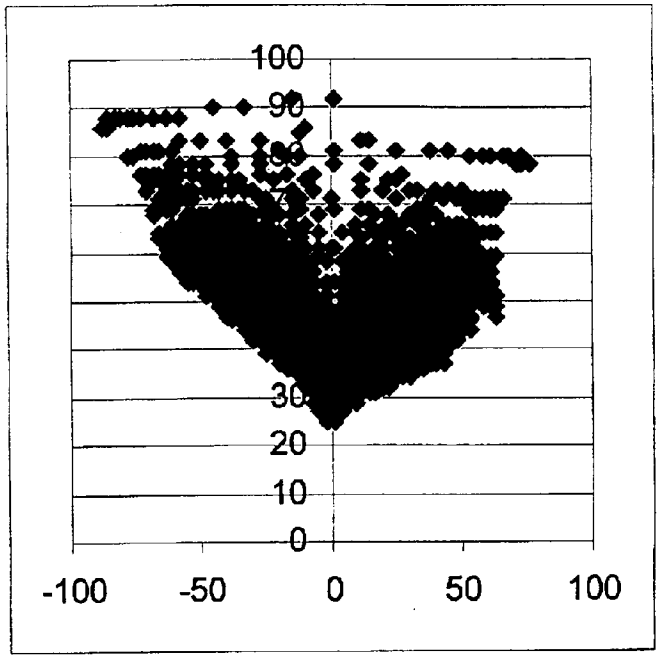
FIG. 11 depicts two projected charts of CMY and CMYK full gamuts generated by the Neugebauer model.
Figure 11:
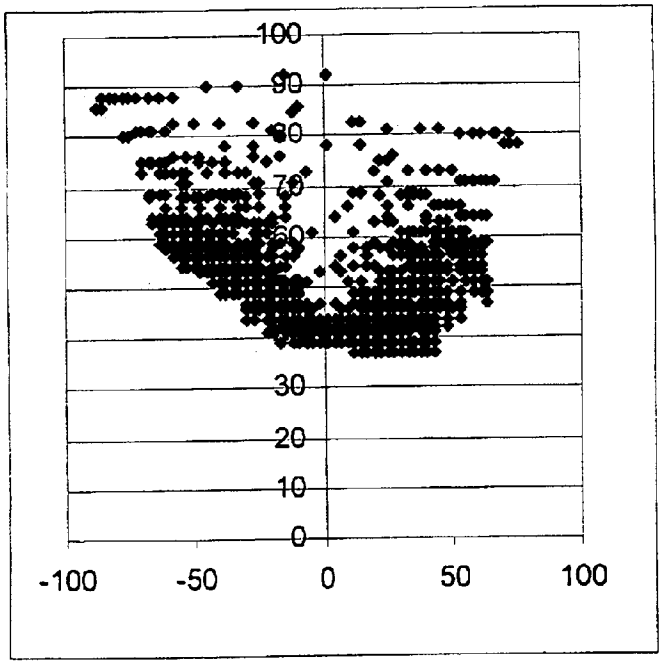

Referring now to FIG. 11, two projected charts of CMY and CMYK full gamuts generated by the Neugebauer model are depicted. Although depicted in black and white, it is understood by those skilled in the art that the a* and b* axes are not parallel to the plane of the paper, and without the use of color, the three-dimensional nature of FIG. 11 may not be readily apparent.

In practice, however, all ink level combinations for CMYK printing would not be used, because some combinations require the use of too much ink and will result in bleed through in the recording medium 34, such as, for example, a combination of C=255, C=255, Y=255, and K=255. Instead, the mixing method of the present invention will obtain a maximized gamut which is the closest to the full gamut, while removing the appropriate process black. This is be accomplished by the following procedures combined with the optimization process to be discussed following discussion of the mixing process.

Referring back to FIG. 2B, at step S126, lightness mapping is performed.

When a CMY point is mixed with black ink, its lightness may be changed or unchanged depending on its position in the colorant space. The lightness of a region with little black ink should not be changed or should be changed only by a very small amount in order to keep a smooth transition with the neighboring region that has no black ink. For the darkest CMY point, its lightness should be changed by the maximum amount. The linearized lightness profile of black is denoted by $$L_k^*=f(K) \text{ for } K=0, 1, 2, 3, \ldots, 255 \quad \text{(Equation 7)}$$

For any CMY point ($C_0$, $M_0$, $Y_0$), the new mapped L* for the mixed CMYK point is given by $$L^*=L_0^*+L_k^*-L_p^* \quad \text{(Equation 8)}$$

where,

- $L^*$, $L_0^*$, $L_k^*$, and $L_p^*$ are device-independent color space lightness values;
- $L_0^*$ is the lightness L* when only CMY colors are used, and is computed using $C_0$, $M_0$, $Y_0$ in the CMY colorant space by the model;
- $L_k^*$ is the lightness produced by the black ink only, given by Equation 7 with K which is computed by Equations 2–6; and
- $L_p^*$ is process black computed with (K, K, K) in the CMY colorant space by the model.

It is noted that, if k=min($C_0$, $M_0$, $Y_0$) and if $C_0=M_0=Y_0$, representing a neutral digital line in the CMY colorant space, are selected, then $L_0^*=L_p^*$ and $L^*=L_k^*$, that is, the lightness profile of the neutral digital line for this situation will be the same as the linearized lightness profile of black denoted by Equation 7.

At step 128, constant hue mapping is performed. After mixing with black ink, a CMY point will keep the same hue angle as in the CIELAB space, and thus the counterpart CMYK point will have the hue angle (H*) given by $$H^*=H_0^*=\tan^{-1}(b_0^*/a_0^*) \quad \text{(Equation 9)}$$

where $a_0^*$ and $b_0^*$ are computed with $C_0$, $M_0$, $Y_0$ in the CMY colorant space by the model, H* is the hue angle in a device-independent color space for the mixed CMYK point, and $H_0^*$ is the hue angle in a device-independent color space for the original CMY point.

Referring now to FIG. 2C, the description of the method is continued.

Figure 12:
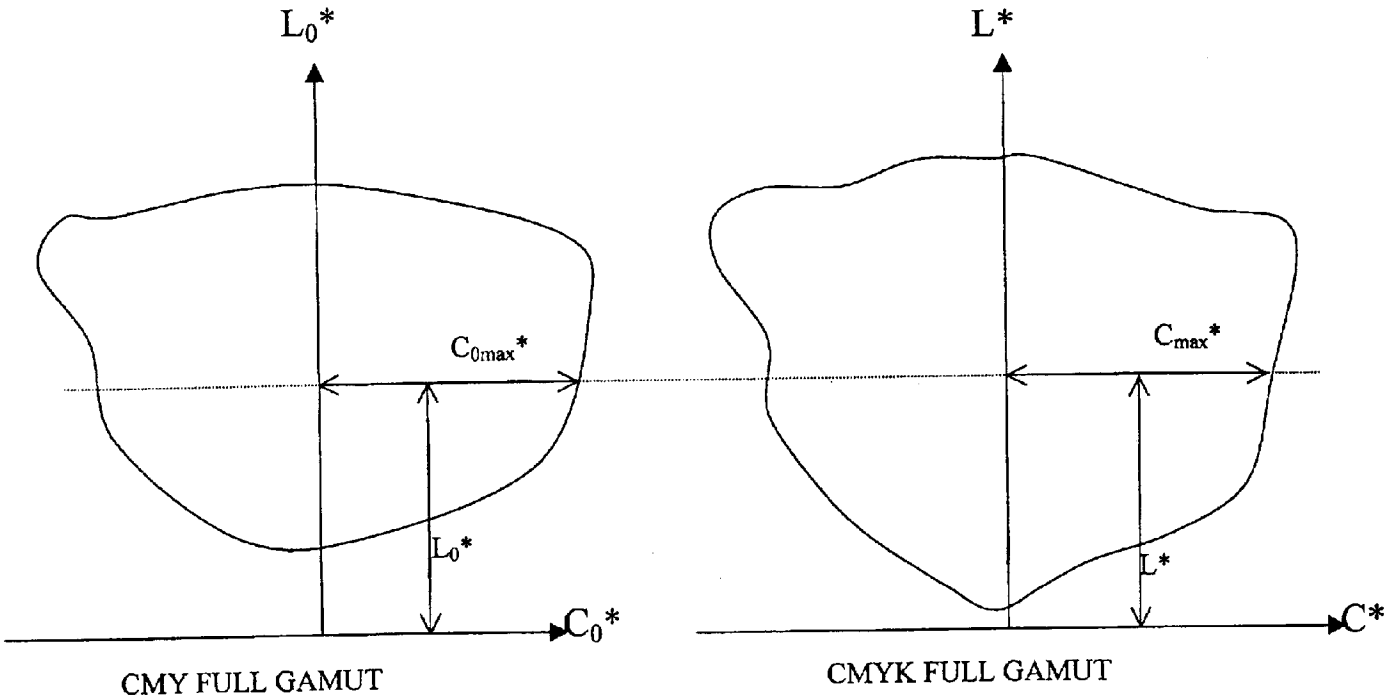
FIG. 12 depicts a comparison of the CMY full gamut and the CMYK full gamut.

At step S130, a chroma (C*) adaptation from CMY full gamut to CMYK full gamut is now performed. Referring now to FIG. 12, a comparison of the CMY full gamut and the CMYK full gamut is depicted. For any CMY point ($C_0$, $M_0$, $Y_0$), the L* and H* for the counterpart CMYK point may be found by the Lightness Mapping (Equations 7 and 8) and Constant Hue Mapping (Equation 9). Using the CMY and CMYK full gamuts, computed with all combinations of available inks by the model, the C* of the mixed CMYK point can be determined as follows:

$$C^*=(C_{max}^*/C_{0max}^*)C_0^* \quad \text{(Equation 10)}$$

where $C_{max}^*$ is the maximum chroma at (L*, H*) in the CMYK full gamut, $C_{0max}^*$ is the maximum chroma at ($L_0^*$, $H_0^*$) in the CMY full gamut, and ($L_0^*$, $C_0^*$, $H_0^*$) is computed with ($C_0$, $M_0$, $Y_0$) in the CMY colorant space by the model, C* is the chroma in a device-independent color space for the mixed CMYK point, and $C_0^*$ is the chroma in a device-independent color space for the original CMY point.

At step S132, C, M, and Y values for each CMYK point from the corresponding CMY point in the CMY gamut are determined with known K, L*, C*, and H* values with Neugebauer model by inverse computation.

For any given CMY point ($C_0$, $M_0$, $Y_0$), the black ink (K) for use in the corresponding CMYK point may be determined using Equations 2–6, and the L*, C*, and H* for the mixed CMYK point (C, M, Y, K) may be determined by the Lightness Mapping (Equations 7 and 8), Constant Hue Mapping (Equation 9), and Chroma Adaptation (Equation 10). Then, with the known values of (K, L*, C*, and H*), the unknown values of C, M, and Y for the mixed CMYK point can be determined using the Neugebauer model by inverse computation.

At step 133, a determination is made as to whether a conversion of each mixing point from each CMY point to its counterpart CMYK point was completed for all CMY points. For example, if 17 values each for $C_0$, $M_0$, and $Y_0$ are used, there is a total of 17×17×17=4913 points to be mixed. If not, steps S122 though S132 are repeated until all CMY points are mixed into corresponding mixed CMYK points.

At step S134, the color gamut for the mixed CMYK space is determined.

At step 136, the parameters for the gamut are saved. These parameters include $\phi$, $\sigma$, $\gamma$, and each $C_0$, $M_0$, $Y_0$, C, M, Y and K for each mixed point.

The above mixing process has mixed a CMY space into a CMYK space. This mixing may not yield a gamut that is the closest to the CMYK full gamut if the black ink usage is not appropriate. To maximize the mixed CMYK gamut, the following optimization process is conducted.

First, the black ink distribution is changed by varying the parameter $\phi$ in Equation 5 from 0.0 to 2.0.

Second, the black ink is computed with Equations 2–6 for a given value of $\phi$.

Third, all CMY points are mixed into CMYK points using the procedures described in the mixing process (see steps S122–S132), above.

Fourth, the mixed CMYK gamut is computed using the modified Neugebauer model.

The optimization process is initiated with step 138. At step S138, a determination is made as to whether $\phi=(\phi+0.2)$ <=2.0. If not, the method returns to step S122, with new computations based on an incremented (p of (p+0.2. Although the incremental value of 0.2 is used here, any appropriate incremental value may be used, and the use of 0.2 is not to be considered as limiting the scope of the present invention. Steps S122 through S138 are executed iteratively for each mixing point until $\phi=(\phi+0.2)$ is not less than or equal to 2.0, at which point execution of the method of the present invention proceeds to step S140. After each iteration, the size of the gamut is compared against the previous iteration, and the maximum of each comparison along with the parameters, including the color gamut for the mixed CMYK color space, parameter σ, and parameter ϕ, are retained, and saved in step S136. Accordingly, upon completion of all iterations, the maximum mixed CMYK gamut with respect to various values of ϕ is obtained and is available for use in step 140.

At step 140, the maximum mixed CMYK color space (corresponding to one value of parameter ϕ) with the maximum gamut is selected, and output to and utilized by printer driver software and/or controller 28 for use by imaging apparatus 20.

Figure 13:
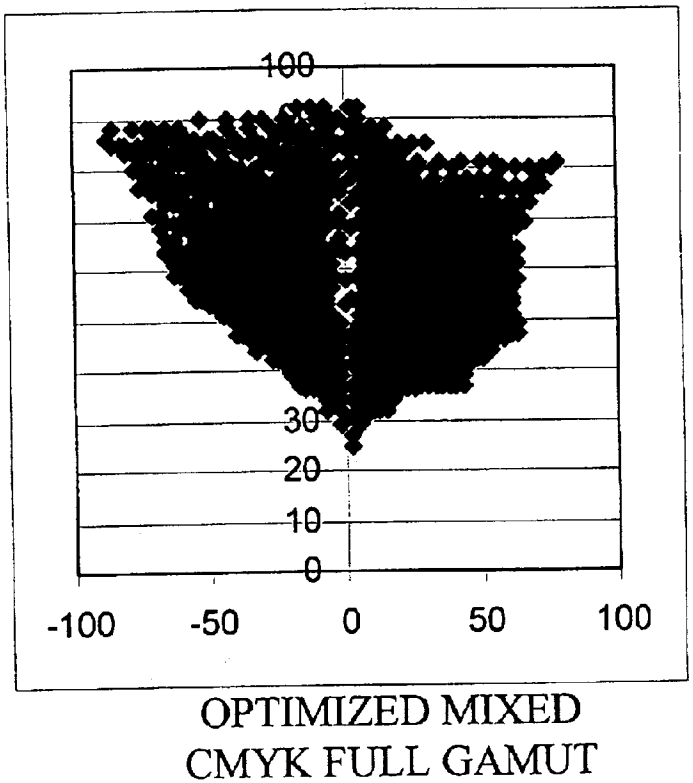
FIG. 13 depicts a projected chart for an optimized mixed CMYK gamut generated by the present invention in comparison with the CMYK full gamut depicted in FIG. 11.
Figure 13:
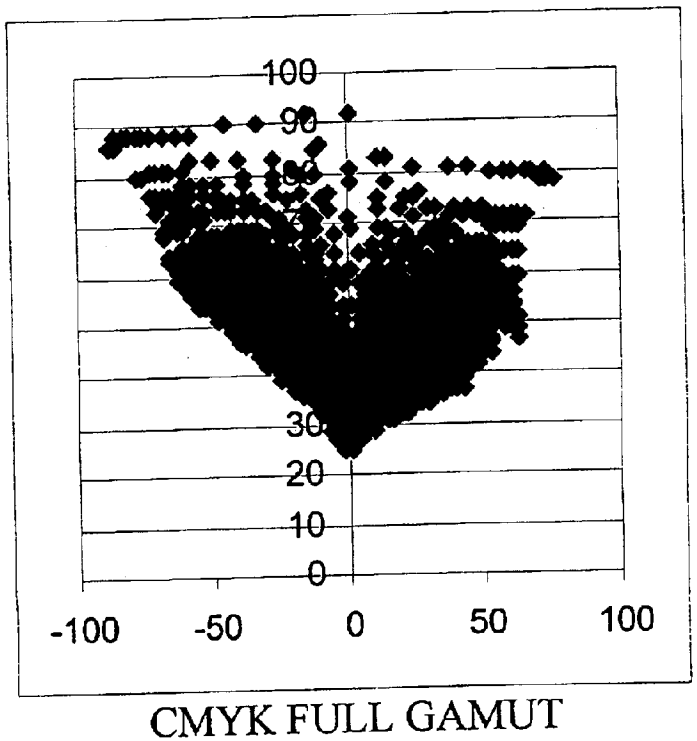

FIG. 13 shows a projected chart for an optimized mixed CMYK gamut together with the CMYK full gamut of FIG. 11. It can be seen that the two gamuts are very close.

When creating a printer profile, one can sample the mixed CMYK space for accurate calibration in the same way as for the CMY space since each CMY point has a link with a CMYK point in the mixed CMYK space. By using the mixed CMYK space, the printer profile will yield a smoothed and maximized color gamut to achieve better printing quality.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for mixing ink for use in an imaging apparatus including an ink jet printer capable of printing a plurality of primary color inks, comprising the steps of:

identifying a plurality of available printing levels for each of said plurality of primary color inks;

determining a target color profile for each of said plurality of primary color inks;

determining a graininess factor for each printing level of said plurality of available printing levels for each of said plurality of primary color inks;

setting a mixing order for at least a portion of said plurality of available printing levels for each of said plurality of primary color inks based in part on corresponding graininess factors and at least one mixing rule; and mixing said at least a portion of said plurality of available printing levels based on said mixing order and said target color profile to generate a plurality of mixing tables, wherein one of each mixing table of said plurality of mixing tables corresponds to one of each of said plurality of primary color inks.

2. The method of claim 1, wherein said plurality of available printing levels includes a diluted level and a saturated level.

3. The method of claim 2, wherein said diluted level includes a diluted small drop level and a diluted large drop level.

4. The method of claim 2, wherein said saturated level includes a saturated small drop level and a saturated large drop level.

5. The method of claim 2, wherein said at least one mixing rule includes:

a first rule, wherein said mixing order is arranged as proceeding from a lightest color of each of said plurality of primary color inks to a darkest color of each of said plurality of primary color inks, whereby in said mixing order a less grainy printing level of said plurality of printing levels is introduced before a more grainy printing level of said plurality of printing levels is introduced, such that said mixing order proceeds from said less grainy printing level to said more grainy printing level;

a second rule, wherein if said diluted level has a larger graininess factor than said saturated level, said diluted level is an unused printing level; and a third rule, wherein said diluted level is not printed on said darkest color.

6. The method of claim 5, further comprising the step of removing any said unused printing level from said mixing order.

7. The method of claim 5, further comprising the step of setting up a Neugebauer model for each of said plurality of primary color inks.

8. The method of claim 5, wherein said plurality of primary color inks includes a cyan ink, a magenta ink, a yellow ink, and a black ink.

9. The method of claim 5, wherein said mixing step comprises the steps of:

mixing printing levels of said at least a portion of said plurality of available printing levels that are not to be printed on said darkest color; and mixing printing levels of said at least a portion of said plurality of available printing levels that are to be printed on said darkest color, wherein said mixing steps generate said plurality of mixing tables; and wherein said each mixing table is a multilevel mixing table.

10. The method of claim 5, further comprising the step of performing a smoothing process on said each mixing table.

11. The method of claim 10, wherein said plurality of primary color inks having said plurality of available printing levels is treated as multiple single level inks via each said multilevel mixing table, and each said multilevel mixing table is forwarded to a CMYK mixing process.

12. The method of claim 11, further comprising the steps of:

determining by image granularity at what darkness level an amount of a black ink should be introduced in said CMYK mixing process; and assigning a result of said determining to a parameter σ.

13. A method for mixing ink for use in an imaging apparatus, comprising the steps of:

providing a plurality of multilevel primary color inks, said plurality of multilevel primary color inks including a plurality of non-black multilevel primary color inks and a black multilevel primary color ink;

determining for each multilevel primary color ink of said plurality of multilevel primary color inks a corresponding target color profile;

generating for each multilevel primary color ink a corresponding mixing table based on said corresponding target color profile;

mixing a black ink K with each non-black multilevel primary color ink of said plurality of non-black multilevel primary color inks using each said corresponding mixing table in mixing a plurality of CMY points in a CMY color space into a plurality of corresponding mixed CMYK points in a mixed CMYK color space wherein a process black amount in each CMY point of said plurality of CMY points is replaced, at least in part, with an amount of said black ink K for use in each said corresponding mixed CMYK point of said plurality of corresponding mixed CMYK points; and optimizing a total amount of said black ink K used in said mixing step, wherein said process black amount is an amount of black color in each of said plurality of CMY points that exists without the use of black ink.

14. The method of claim 13, wherein said each multilevel primary color ink includes a diluted level and a saturated level.

15. The method of claim 14, wherein said diluted level includes a diluted small drop level and a diluted large drop level.

16. The method of claim 14, wherein said saturated level includes a saturated small drop level and a saturated large drop level.

17. The method of claim 13, wherein said plurality of non-black multilevel primary color inks includes a cyan ink, a magenta ink, and a yellow ink.

18. A method for mixing ink for use in an imaging apparatus, comprising the steps of:

providing a plurality of multilevel primary color inks, said plurality of multilevel primary color inks including a plurality of non-black multilevel primary color inks and a black multilevel primary color ink;

determining for each multilevel primary color ink of said plurality of multilevel primary color inks a corresponding target color profile;

generating for each multilevel primary color ink a corresponding mixing table based on said corresponding target color profile, wherein a mixing order is used to generate each said corresponding mixing table;

mixing a black ink K with each non-black multilevel primary color ink of said plurality of non-black multilevel primary color inks using each said corresponding mixing table in mixing a plurality of CMY points in a CMY color space into a plurality of corresponding mixed CMYK points in a mixed CMYK color space wherein a process black amount in each CMY point of said plurality of CMY points is replaced, at least in part, with an amount of said black ink K for use in each said corresponding mixed CMYK point of said plurality of corresponding mixed CMYK points; and optimizing a total amount of said black ink K used in said mixing step, wherein said process black amount is an amount of black color in each of said plurality of CMY points that exists without the use of black ink.

19. The method of claim 18, wherein said mixing order is based in part on at least one graininess factor and at least one mixing rule.

20. The method of claim 19, wherein for said each multilevel primary color ink, said at least one mixing rule includes:

a first rule, wherein said mixing order is arranged as proceeding from a lightest color to a darkest color, whereby in said mixing order a less grainy printing level is introduced before a more grainy printing level is introduced, such that said mixing order proceeds from said less grainy printing level to said more grainy printing level;

a second rule, wherein if a diluted level has a larger graininess factor than any saturated level, said diluted level is an unused printing level; and a third rule, wherein said diluted level is not printed on said darkest color.

21. The method of claim 20, wherein said at least one graininess factor is determined by the equation, wherein d is a dot diameter of a printed ink droplet, n is a number of printed dots per an image input pixel supplied to said imaging apparatus, and q is an actual digital count determined under a same lightness L* value for each of said plurality of printing levels.

22. The method of claim 20, said generating step including the step of removing any said unused printing level from said mixing order.

23. The method of claim 20, further comprising the step of setting up a Neugebauer model for said each multilevel primary color ink.

24. The method of claim 20, wherein any printing level that is not an unused printing level is a used printing level of a plurality of used printing levels, said mixing step comprises the steps of:

mixing any of said used printing levels that are not to be printed on said darkest color; and mixing any of said used printing levels that are to be printed on said darkest color, wherein said each corresponding mixing table is a multilevel mixing table.

25. The method of claim 20, further comprising the step of performing a smoothing process on said each corresponding mixing table.

26. The method of claim 20, wherein said plurality of multilevel primary color inks are treated as multiple single level inks via said each corresponding mixing table, and said each corresponding mixing table is forwarded to a CMYK mixing process.

27. The method of claim 20, further comprising the step of determining by image granularity at what darkness level said black ink should be introduced in said mixing step.

* * * * *